US005193784A

United States Patent [19]

Obernberger

[11] Patent Number: 5,193,784

[45] Date of Patent: Mar. 16, 1993

[54] METHOD AND APPARATUS FOR LIFTING

[76] Inventor: Donald J. Obernberger, 733 Vista Pacifica Cir., Pismo Beach, Calif. 93449

[21] Appl. No.: 667,201

[22] Filed: Mar. 11, 1991

[51] Int. Cl.[5] ..... B66F 3/00

[52] U.S. Cl. ..... 254/1; 254/126; 254/134; 254/89 R

[58] Field of Search ..... 254/8 B, 8 R, 3 B, 3 R, 254/133, 134, 122, 124, DIG. 1, DIG. 4, 89 R, 89 H, 1

[56] References Cited

U.S. PATENT DOCUMENTS

| | | | |
|---|---|---|---|
| 1,982,642 | 12/1934 | Curok | 254/126 |
| 2,165,366 | 7/1939 | Gormley | 254/133 R |
| 3,555,934 | 1/1971 | Merino | 254/122 |
| 3,881,692 | 5/1975 | Clarke | 254/DIG. 1 |
| 4,084,791 | 4/1978 | Marqueratt | 254/DIG. 1 |
| 4,090,689 | 5/1978 | Enzenauer et al. | 254/89 R |
| 4,251,056 | 2/1981 | Maniglia | 254/8 B |
| 4,324,384 | 4/1982 | Elser | 254/8 B |
| 4,558,848 | 12/1985 | Rutter | 254/133 R |
| 4,624,448 | 11/1986 | Lawman et al. | 254/122 |
| 4,688,759 | 8/1987 | Gray | 254/134 |
| 4,723,756 | 2/1988 | Stumpf | 254/134 |
| 4,787,600 | 11/1988 | Bode | 254/134 |
| 4,793,592 | 12/1988 | Green et al. | 254/134 |
| 4,793,593 | 12/1988 | Pittman | 254/89 H |
| 4,885,918 | 12/1989 | Vaccaro | 254/122 |

*Primary Examiner*—Robert C. Watson
*Attorney, Agent, or Firm*—Timothy T. Tyson

[57] ABSTRACT

A lifting apparatus (30) configured with independent lifting means at opposite ends of the longitudinal axis of a base (40) is provided. Slidable transverse support combined with an ability of the lifting means to tilt longitudinally causes the apparatus to be particularly suitable for lifting two wheeled vehicles such as a motorcycle (20).

7 Claims, 4 Drawing Sheets

METHOD AND APPARATUS FOR LIFTING

TECHNICAL FIELD

The present invention pertains to lifting apparatus and more particularly, to apparatus employing multiple lifting means.

BACKGROUND ART

Some vehicles such as motorcycles can be difficult to lift for the purpose of repairs due to the inherent instability of a two wheeled device when at rest. Sometimes a standard jack is employed in conjunction with ropes or other attachments from the motorcycle to a source of support such as a building. At least one manufacturer (Harley Davidson) offers a cam type jack that lifts the rear wheel a pre-set height from the ground but no variation in height, to facilitate repairs, is possible. Sophisticated work benches are available but, because of their high expense, are restricted to the use of motorcycle dealers and others who can rationalize the cost.

U.S. patents of interest in the art are U.S. Pat. Nos. 1,780,266 to Lolley, 2,132,343 to Jarrett, 2,470,105 to Murphy, 2,563,927 to Engle, 2,902,349 to Lerner, 3,326,527 to Jenkins, 3,606,255 to Stevens, 3,614,064 to Adamski, 4,180,252 to Cushenbery and 4,441,736 to Shedden.

DISCLOSURE OF INVENTION

The present invention is directed to lifting apparatus and further specifically directed to lifting apparatus for two wheel vehicles such as motorcycles.

Apparatus in accordance with the invention are characterized by independent lifting means disposed at each end of the longitudinal axis of an apparatus base. The independent lifting means are configured to tilt along the longitudinal axis to prevent slippage between their bearing surfaces and the object lifted. Such apparatus is further characterized by slidable guide means that prevent transverse movement while permitting extension normal to the apparatus base. Such apparatus is further characterized by means for locking the independent means in a fixed position normal to the apparatus base.

In a preferred embodiment a pair of scissors jacks are disposed at opposite ends of a base comprised of tubular members. Transverse support is supplied by a tube attached to each jack that slides vertically between two tubes attached to the base. This arrangement and the inherent construction of the scissors jacks allows tilting along the longitudinal axis of the base. A stop formed of tubular members is hinged on the base so as to swing to a position where the vertical position of one of the scissors jacks is locked. Resilient strips of rubber are arranged as the bearing surfaces for the lifted object. The friction thus provided combines with the tilting ability of the jacks to prevent slippage of the lifted object.

The novel features of the invention are set forth with particularity in the appended claims. The invention will be best understood from the following description when read in conjunction with the accompanying drawings.

MODES FOR CARRYING OUT THE INVENTION

Figure 1:
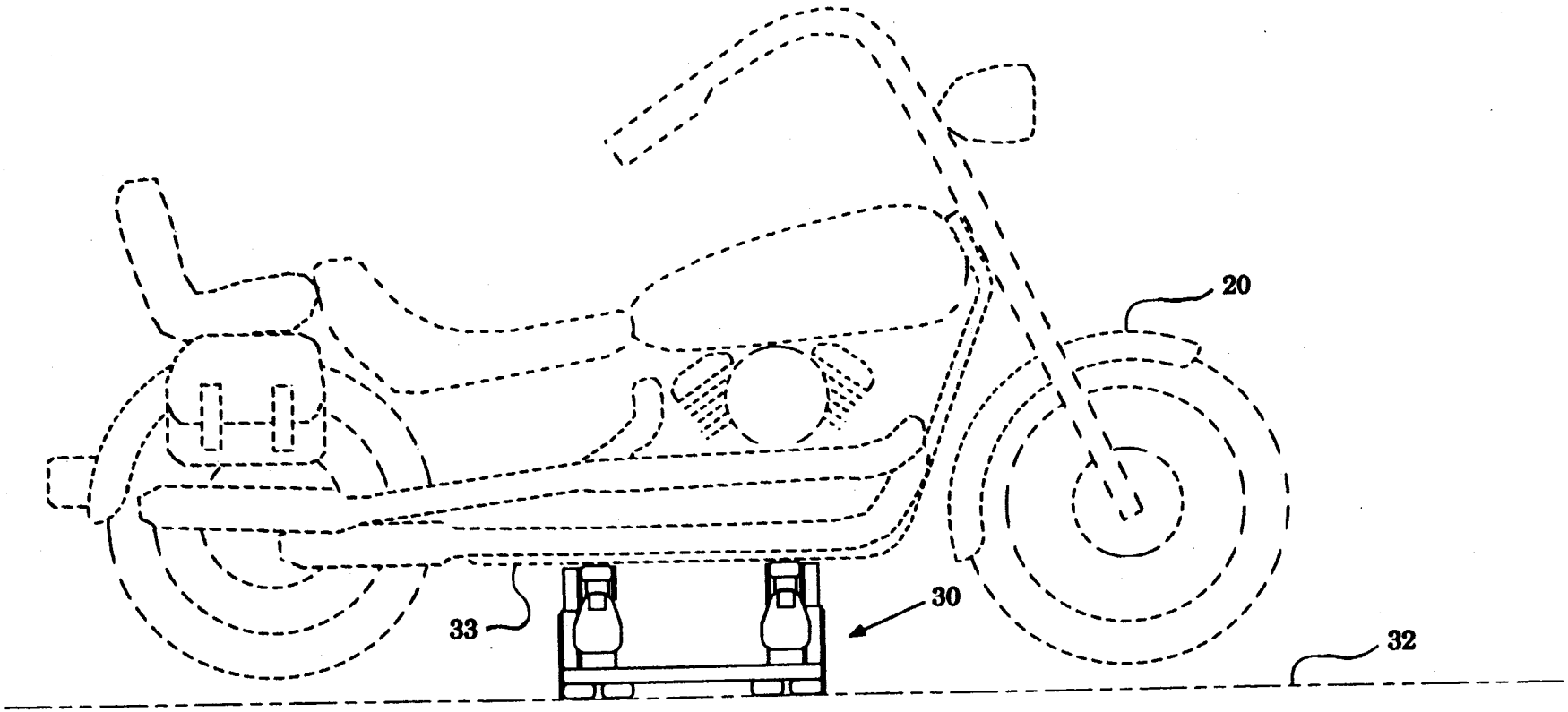
FIG. 1 is a side elevation view of a motorcycle on a lifting apparatus in accordance with an embodiment of the present invention.

FIG. 1 is a side elevation view illustrating a motorcycle 20 lifted by a lifting apparatus 30, in accordance with an embodiment of the present invention, above a surface 32 on which the apparatus 30 is placed. The lifting apparatus 30 contacts the frame 33 of the motorcycle 20.

Figure 2:
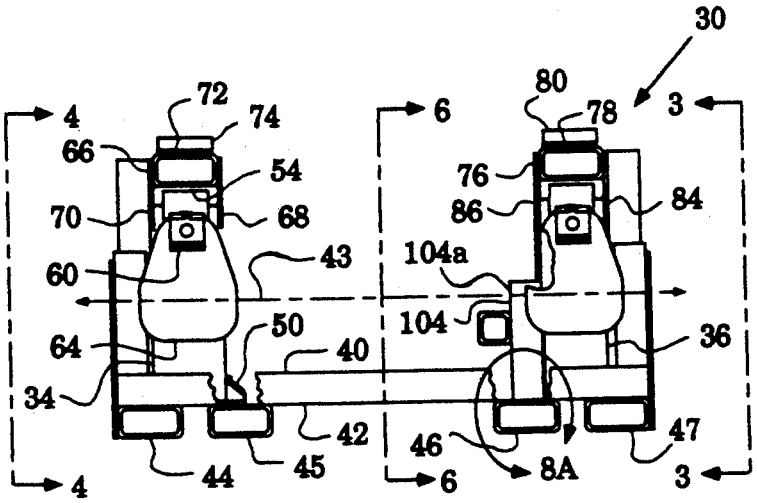
FIG. 2 is an side elevation view of the lifting apparatus of FIG. 1.
Figure 3:
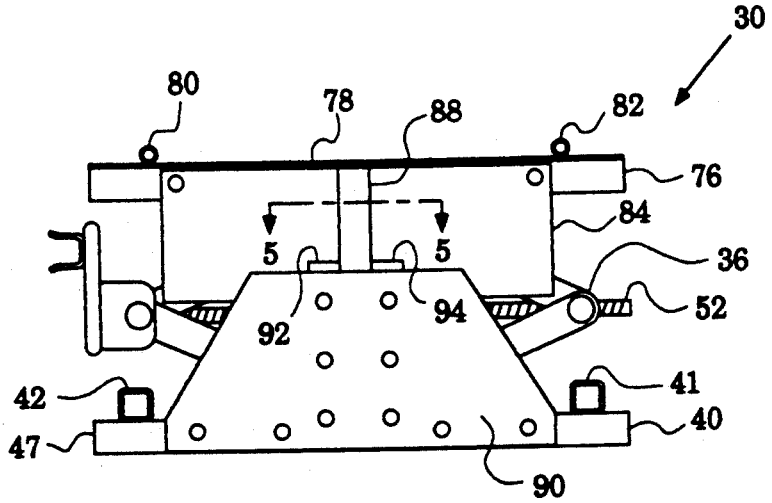
FIG. 3 is a view along the plane 3—3 of FIG. 2.
Figure 4:
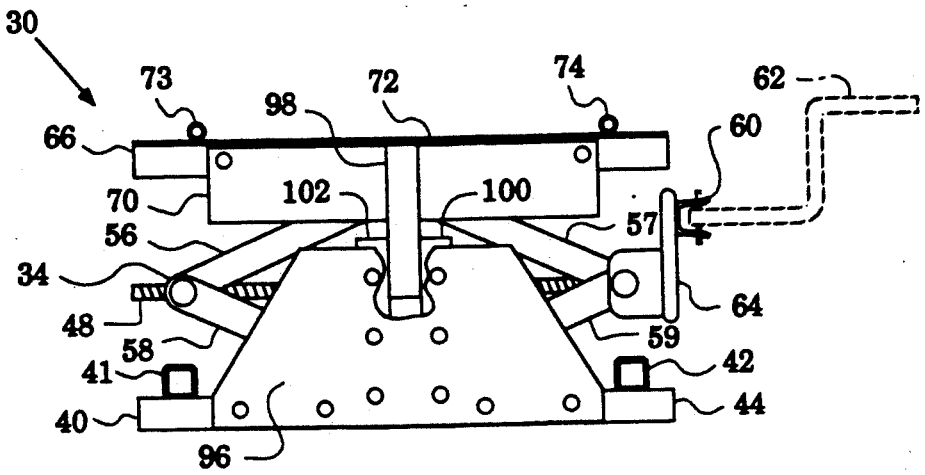
FIG. 4 is a view along the plane 4—4 of FIG. 2.

FIG. 2 is a side elevation view of the lifting apparatus 30 illustrating a pair of scissors jacks 34, 36 mounted on a base 40. FIG. 3 is a view along the plane 3—3 of FIG. 2 and FIG. 4 is a view along the plane 4—4 of FIG. 2. In FIGS. 2, 3 and 4, the base 40 is seen to be formed of hollow tubing. Two longitudinal rails, 41, 42 are oriented along the longitudinal axis, indicated by the arrow 43 in FIG. 2, of the base 40. The longitudinal rails 41, 42 are attached to four transverse rails 44, 45, 46 and 47 which are oriented transversely on the base 40.

The scissors jack 34 is mounted to the transverse rails 44, 45 with its jack screw 48 oriented transversely on the base 40. The jack base 50 (seen in FIG. 2 behind the cut away portion of longitudinal rail 42) of the scissors jack 34 is attached to the transverse rails 44, 45. In a similar manner, the scissors jack 36 is mounted to the transverse rails 46, 47 with its jack screw 52 oriented transversely on the base 40.

The scissors jacks 34, 36 are of a type well known in the art. As an example of their operation, the scissors jack 34 has a jack head 54 (seen in FIG. 2) that moves relative to the jack base 50 in response to turning of the jack screw 48. The jack screw 48 runs through a pair of nuts (not shown) to transmit force to upper scissor links 56, 57 and lower scissor links 58, 59. The jack screw 48 is turned in response to turning the jack clevis 60 with an external jack handle 62 as shown in FIG. 4. Mechanical advantage is provided by a chain driven transmission 64. Thus, as mounted on the base 40, the extension of the jack head 54, as the scissors jack 34 is operated, is normal to the base 40. The scissors jack width is substantially the same width as the jack head 54. The scissors jack length is substantially the same as the length of the jack screw 52. In the example of a scissors jack illustrated in the figures, the scissors jack length is 9.3 times the scissors jack width.

The scissors jack 34 has a bearing rail 66 attached to its jack head 54 with the support of a pair of short skirts 68, 70. A resilient strip of rubber forms a bearing surface 72 attached to the top of the bearing rail 66. The bearing surface 72 has a high coefficient of friction relative to the frame 33 of the motorcycle (20 in FIG. 1) which prevents longitudinal and transverse slippage therebetween. Attached outboard on the bearing rail 66 are a pair of retainers 73, 74 to further prevent transverse slippage of the motorcycle frame. The bearing rail 66 is of tubing similar to the transverse rails 44, 45, 46 and 47. The retainers 73, 74 are formed of tubular vinyl. In a similar manner, the scissors jack 36 has a bearing rail 76 with a bearing surface 78 and a pair of retainers 80, 82. In the case of the scissors jack 36, the bearing rail 76 is attached with the aid of a pair of long skirts 84, 86.

Also illustrated in FIGS. 2, 3 and 4 is a slidable guide to provide transverse support for the scissors jacks 34, 36. This will be described relative to the scissors jack 36. A slidable guide is provided in a similar manner for the scissors jack 34. Attached to the long skirt 84, the bearing rail 76 and the jack head (not shown) of the scissors jack 36 is a jack bar 88. The jack bar 88 is oriented normal to the plane of the base 40. Mounted to the base 40 with the aid of a gusset 90 are a pair of guide bars 92, 94. The guide bars 92, 94 are parallel and adjacent to the jack bar 88. They are spaced from the jack bar 88 sufficiently to allow free travel of the jack bar 88 normal to the base 40. The jack bar 88 and the guide bars 92, 94 are fabricated of tubing similar to that of the longitudinal rails 41, 42.

Figure 5:
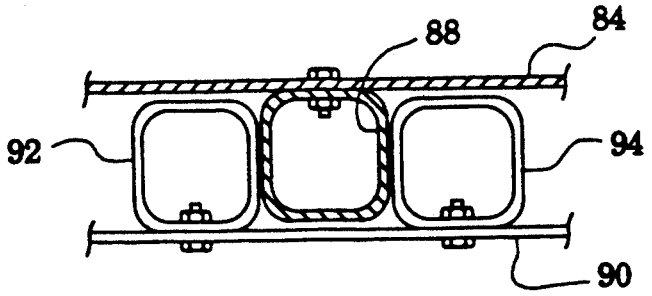
FIG. 5 is an enlarged view along the plane 5—5 of FIG. 3.

The relationship of jack bar 88 to the guide bars 92, 94 is clearly seen in FIG. 5 which is an enlarged view along the plane 5—5 of FIG. 3. The operation of the slidable guide described above can be further appreciated in FIG. 4 (in relation to the scissors jack 34) where a portion of the gusset 96 has been removed to show jack bar 98 slidably mounted between guide bars 100, 102. Thus the scissors jacks 34, 36 are given transverse support while allowed free movement normal to the base 40.

Figure 6:
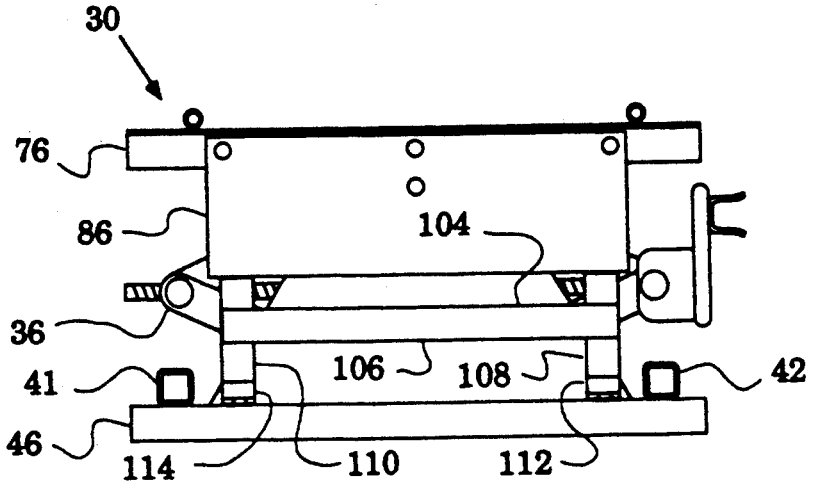
FIG. 6 is a view along the plane 6—6 of FIG. 2.
Figure 7:
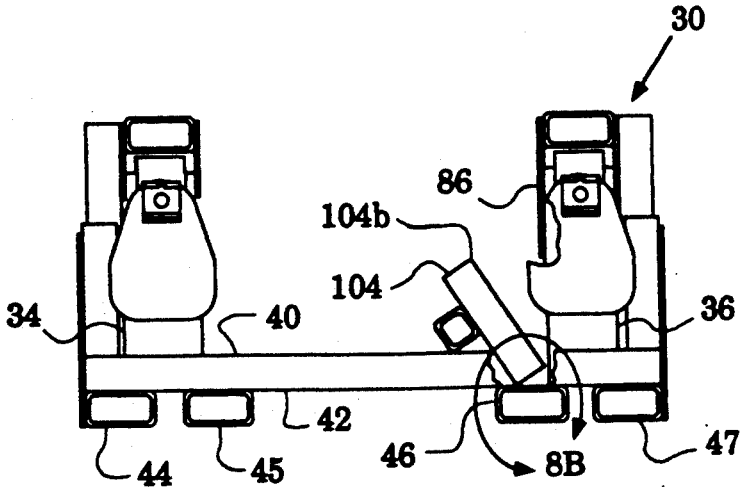
FIG. 7 is a view similar to FIG. 2.

FIG. 6 is a view along the plane 6—6 of FIG. 2 illustrating a rotatable stop 104 formed of a cross rail 106 and a pair of uprights 108, 110 which are of a tubing similar to the longitudinal rails 41, 42 of FIGS. 2, 3 and 4. The stop 104 is mounted with hinges 112, 114 to the transverse rail 46. The rotation of the stop 104 is further illustrated in FIG. 2 and FIG. 7 which is a view similar to FIG. 2. The stop 104 is shown in position 104*a* in FIG. 2 and FIG. 6 and in position 104*b* in FIG. 7. When the stop 104 is in position 104*a* the scissors jack 36 may be lowered to cause the long skirt 86 to abut the stop 104.

Figure 8A:
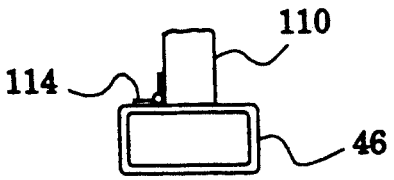
FIG. 8A is an enlarged view of the area enclosed by the line 8A of FIG. 2.
Figure 8B:
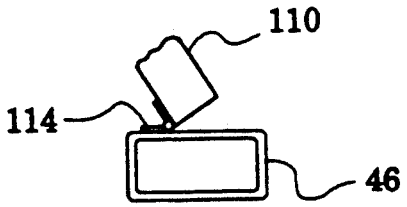
FIG. 8B is an enlarged view of the area enclosed by the line 8B of FIG. 7.

Thus the vertical position of the bearing rail 76 can be locked allowing for fine adjustments of the scissors jack 34 without affecting the scissors jack 36 position. When not in use the stop 104 is swung out to the position 104*b*. The hinge action of the stop 104 is clearly seen in FIGS. 8A and 8B which are enlarged views of the areas enclosed by the lines 8A and 8B of FIGS. 2 and 7 respectively.

The construction of the lifting apparatus 30 described above is accomplished with standard hardware well known in the art (e.g. nuts, bolts, self tapping bolts) and such hardware is indicated, to aid understanding of the apparatus, by small circles as, for example, in FIGS. 2 through 4. Other standard construction techniques can, of course, be used.

Figure 9:
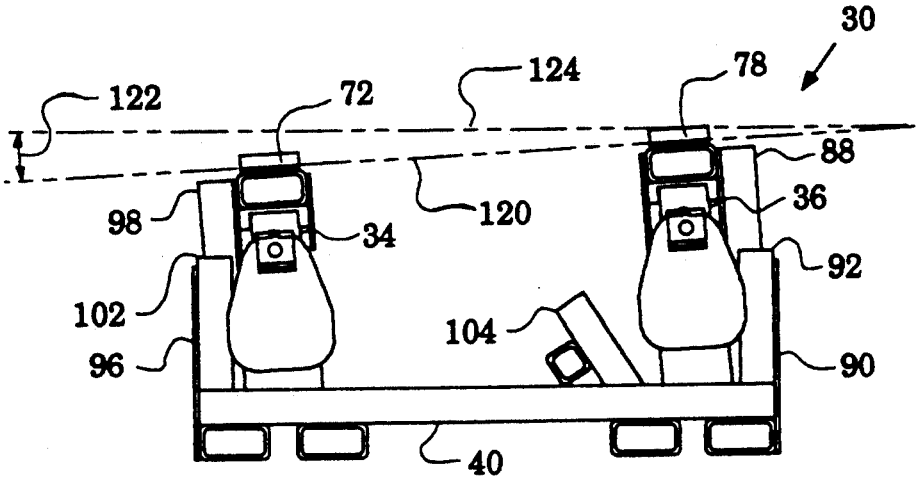
FIG. 9 is a view similar to FIG. 2.

FIG. 9 is a view similar to FIG. 2 illustrating, in accordance with an important feature of the present invention, that the inherent mechanical structure of the scissors jacks 34, 36 of the apparatus 30 allows them to tilt along the longitudinal axis (43 in FIG. 2) of the base 40 to maintain full contact with the lifted object. The construction of the slidable guides described with reference to FIGS. 2 through 5 further permits this longitudinal tilt as can be seen by the spatial relationships in FIG. 9 between the jack bar 98 and the guide bar 102 and betwen the jack bar 88 and the guide bar 92.

Consequently, as the scissors jack 36 is raised above the scissors jack 34, in FIG. 9, the bearing surfaces 72, 78 are automatically maintained parallel with the motorcycle frame (33 in FIG. 1) which is indicated by the phantom line 120. Due to this feature full contact and friction is retained between the motorcycle frame and the resilient bearing surfaces 72, 78 to prevent longitudinal slippage therebetween. This is particularly useful when, as opposed to the situation illustrated in FIG. 1, only one wheel of the motorcycle 20 is lifted from the surface 32. In such a configuration the frame 33 will not be parallel to the surface 32 and without the ability to tilt in the longitudinal direction (43 in FIG. 2) of the base 40 slippage might occur between the frame 33 and the bearing surfaces 72, 78. The construction of the lifting apparatus allows a maximum angle 122 between the line 120 and the plane 124 of the mounting surface (32 in FIG. 1) of 16 degrees.

Figure 10:
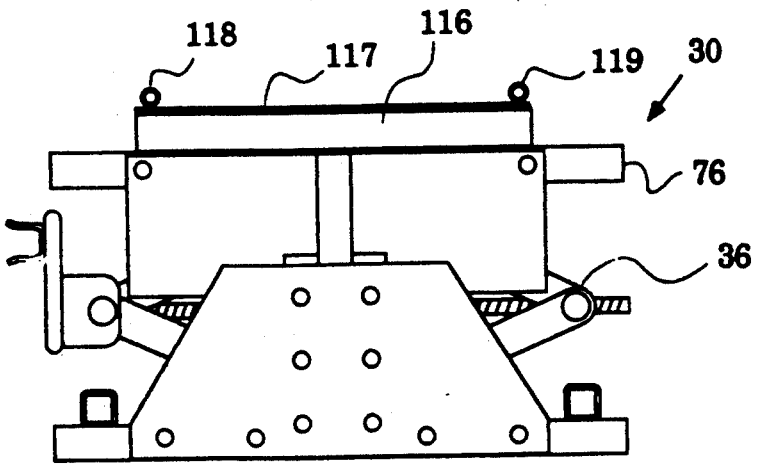
FIG. 10 is a view similar to FIG. 3.

FIG. 10 is a view similar to FIG. 3 illustrating the use of a bearing jig 116 with attached bearing surface 117 and retainers 118, 119. Such a bearing jig may be attached to the bearing rail 76 to accommodate objects to be lifted by the lifting apparatus 30. The design of such bearing jigs may take many forms in order to bear on a structural surface of the object to be lifted and avoid damage to other parts of the object. Such bearing jigs can, of course, be also attached to the bearing rail 66 shown in FIG. 4.

From the foregoing it should be recognized that a lifting apparatus has been disclosed herein having independent lifting means and having the capability of maintaining full contact with a lifted object over a range of longitudinal tilt. The lifting apparatus disclosed has slidable guide means providing transverse support to the lifting means and a stop that can stabilize the position of one of the lifting means. Although the lifted object described herein is a motorcycle it should not be limited thereto.

Although the present invention has been described with reference to preferred embodiments, numerous modifications and rearrangements can be made with the equivalent result still embraced within the scope of the invention.

What is claimed is:

1. Apparatus suitable for lifting a motorcycle to independently selected wheel heights, comprising:

a base;

a pair of scissors jacks, each of said scissors jacks having a jack head coupled to said base through a set of scissors links and movable relative to said base by turning a jack screw, said scissors jacks coupled to said base in a spaced longitudinal relationship; and a slidable guide means coupled to each of said jack heads and said base, each of said slidable guide means substantially prohibiting transverse movement of its jack head with respect to said base while permitting normal and longitudinal movement of its jack head relative to said base.

2. The apparatus of claim 1 wherein said slidable guide means includes:

an elongated jack bar arranged normal to said base and attached to said jack head; and a pair of elongated guide bars arranged normal to said base, spaced transversely on either side of and adjacent said elongated jack bar, and attached to said base.

3. The apparatus of claim 2 further comprising:

a member attached to said jack head of one of said scissors jacks; and, a stop rotatably attached to said base to abut said member to lock the position of said jack head relative to said base.

4. The apparatus of claim 1 wherein:

each of said scissors jacks includes:

said jack screw arranged transverse to said base and having a scissors jack length;

said set of scissors links includes a first group of links arranged parallel to and spaced from said jack screw and a second group of links arranged parallel to said first group on the opposite side of said jack screw and spaced from said first group a scissors jack width; and said scissors jack length greater than said scissors jack width; and said jack screws of said pair of scissors jacks parallel to each other.

5. The apparatus of claim 4 wherein said scissors jack length is greater than five times said scissors jack width.

6. A method for lifting a motorcycle to independently selected wheel heights, comprising the steps of:

providing a base with a pair of spaced scissors jacks attached thereto with their jack screws substantially parallel;

supporting the jack head of each of said scissors jacks with a slidable guide means coupled to each of said jack heads and said base, each of said slidable guide means substantially prohibiting transverse movement of its jack head with respect to said base while permitting normal and longitudinal movement of its jack head relative to said base;

disposing said base beneath said motorcycle; and turning said jack screws to raise said jack heads to abut said motorcycle at a predetermined distance from each other and continuing to turn said jack screws until said motorcycle is lifted to obtain the selected wheel heights without changing said predetermined distance.

7. The method of claim 6 further comprising the steps of:

attaching a member to said jack head of one of said scissors jacks and a rotatable stop to said base;

rotating said stop to a position beneath said member; and turning said jack screw of said one of said scissors jacks to lower said member to abut said stop and turning the other of said jack screw of the other of said scissors jacks to make fine adjustments of said selected wheel heights.

* * * * *